US011952851B2

(12) United States Patent
Tydelski

(10) Patent No.: US 11,952,851 B2
(45) Date of Patent: Apr. 9, 2024

(54) SUCTION-ACTIVATED CORE CATCHER AND RELATED METHODS

(71) Applicant: BENTHIC USA LLC, Houston, TX (US)

(72) Inventor: Matthew Tydelski, Houston, TX (US)

(73) Assignee: BENTHIC USA LLC, Houston, TX (US)

( * ) Notice: Subject to any disclaimer, the term of this patent is extended or adjusted under 35 U.S.C. 154(b) by 437 days.

(21) Appl. No.: 17/264,087

(22) PCT Filed: Aug. 1, 2019

(86) PCT No.: PCT/US2019/044625

§ 371 (c)(1),
(2) Date: Jan. 28, 2021

(87) PCT Pub. No.: WO2020/028640

PCT Pub. Date: Feb. 6, 2020

(65) Prior Publication Data

US 2021/0310323 A1 Oct. 7, 2021

Related U.S. Application Data

(60) Provisional application No. 62/713,842, filed on Aug. 2, 2018.

(51) Int. Cl.
*E21B 25/06* (2006.01)
*E21B 25/18* (2006.01)

(52) U.S. Cl.
CPC ..... *E21B 25/18* (2013.01); *E21B 25/06* (2013.01)

(58) Field of Classification Search
CPC ..... E21B 25/06; E21B 25/18
See application file for complete search history.

(56) References Cited

U.S. PATENT DOCUMENTS 3,008,529 A * 11/1961 Lynch ..... E21B 25/06 175/243
3,807,234 A 4/1974 Duperon
4,605,075 A 8/1986 Radford et al.
5,101,917 A * 4/1992 Abdul ..... E21B 25/10 175/58

(Continued)

FOREIGN PATENT DOCUMENTS

AR 234842 6/1987
AR 300705 A1 9/1998

(Continued)

*Primary Examiner* — Matthew R Buck
(74) *Attorney, Agent, or Firm* — Dickinson Wright PLLC; Andrew D. Dorisio

(57) ABSTRACT

An apparatus for recovering a core from an undersea formation. A coring tool adapted for being connected to a drill string includes a coring bit for recovering the core from the undersea formation. A catcher has a closed state for sealing the core in the coring tool. A retainer retains the collapsible catcher in an open state, and an actuator applies suction to the coring tool. The applied suction serves to move the retainer to allow the catcher to collapse for capturing the core, such as by releasing flexible fingers of the core catcher from a telescoping liner associated with the retainer. Related methods are also disclosed.

23 Claims, 3 Drawing Sheets

(56) References Cited

U.S. PATENT DOCUMENTS

| | | | | |
|---|---|---|---|---|
| 5,644,091 | A * | 7/1997 | Jacq | E21B 25/06 73/864.44 |
| 6,394,192 | B1 * | 5/2002 | Frazer | E21B 7/124 175/58 |
| 10,859,472 | B2 * | 12/2020 | Looijen | E21B 25/14 |
| 2012/0073875 | A1 * | 3/2012 | Choi | E02D 1/04 175/20 |
| 2016/0153869 | A1 * | 6/2016 | Niu | E21B 25/10 73/864.74 |

FOREIGN PATENT DOCUMENTS

| | | | | |
|---|---|---|---|---|
| AR | 010430 | A1 | 6/2002 | |
| AR | 303146 | A1 | 12/2003 | |
| FR | 3040422 | A1 * | 3/2017 | E21B 25/06 |
| JP | 61175543 | A * | 8/1986 | |
| WO | WO-2016191792 | A1 * | 12/2016 | |

* cited by examiner

SUCTION-ACTIVATED CORE CATCHER AND RELATED METHODS

This application claims the benefit of U.S. Provisional Patent Application Ser. No. 62/713,842, the disclosure of which is incorporated herein by reference.

FIELD OF THE INVENTION

This disclosure relates to an apparatus for the coring and extraction of subterranean formations for inspection and analysis and, more particularly, a coring apparatus capable of extracting fragmented and unconsolidated soil, especially from undersea formations.

BACKGROUND

The ubiquitous rotary coring design includes a rotating outer barrel coupled with a hollow cutting bit and an inner, stationary string comprised of a bearing section, sample liner, and sample retainer. As the tool drills, the central cavity in the cutting bit produces a cylindrical core that moves into the sample liner. Predominantly, these tools retain the core by means of a spring collet that permits the sample to freely enter the liner and wedges between the sample and a converging wall during retrieval, gripping the sample by friction. However, this retainer is only effective on hard, consolidated material and, due to the large opening, allows the unfettered release of the ensuing detritus when drilling through fragile geologies.

To eliminate the shortcomings of conventional rotary coring tools in recalcitrant unconsolidated ground, others have supplanted the standard core lifter with a special retainer mechanism, predicated on common soil catchers, which fully encapsulates the fine, loose particles. The catcher is typically held open by a retaining member to preclude premature activation by debris until the sample run has concluded. However, these solutions rely on temperamental methods or require surface intervention and large diameter tools, which is simply not feasible on remotely operated, subsea drilling platforms.

SUMMARY

The disclosed apparatus comprises a coring tool forming part of a unique drilling system capable of evacuating the fluid from the sealed drill string, as in U.S. Pat. No. 6,394,192, the disclosure of which is incorporated herein by reference, and is intended for the coring of gravels, dense sands, and similar loosely consolidated formations. The portable drilling system includes a hydraulic system to execute all drilling functions and the capacity to carry its own tool suite. The drill is deployed to the seafloor and operated remotely from a surface vessel.

In one particular embodiment, the tool comprises an outer tube associated with a hollow coring bit and a nested, stationary tube suspended from the top of the outer barrel by a bearing interface. In certain embodiments, the inner tube comprises an actuator comprising a piston, which is displaced by applied suction, and a retainer in the form of a telescoping, tubular liner that shifts concurrently with, or subsequently to, the application of suction. The catcher may comprise an array of flexible fingers configured to lean centrally inward and exert a spring force to their natural position when elastically deformed outwards, as in the preset position achieved by engagement with the telescoping, tubular liner. The default catcher position fully encloses the central cavity and inhibits any particles from passing through, thereby sealing the core within the tool.

Preceding deployment, the catcher is preset to a constrained open state by the tubular liner to allow the unrestricted entry of the core. The sample is guided in the liner as the outer tube advances, cutting an annular void to make a central core. At the end of the sample stroke, suction of the drilling fluid in the sealed drill string may be initiated. Suction may be achieved through an actuator comprising a three-chamber hydraulic cylinder. Two chambers of the cylinder control the bidirectional piston movement and a third chamber is connected to the drill string fluid.

When the piston is displaced by the intentional injection of hydraulic fluid, the volume of the third chamber expands, consequently withdrawing drilling fluid into the cylinder. As the drill string volume expands, the internal pressure drops, and the external pressure forces and shifts the internal mechanism to maintain equilibrium. The internal liner telescopes upon deliberate and efficacious actuation, exposing, and then releasing the flexible fingers of the core catcher to spring inward to their normal closed state, effectively capturing the core. In certain embodiments, the fully closed catcher may be coupled with a standard core lifter to capture both consolidated and fragmented formations.

BRIEF DESCRIPTION OF THE DRAWINGS

The figures and following description reflect only one specific embodiment to illustrate the method and apparatus, and do not limit the disclosure to any one particular manifestation of the disclosed inventions. The figures are listed below.

DETAILED DESCRIPTION OF A PREFERRED EMBODIMENT OF THE INVENTION

Figure 1:
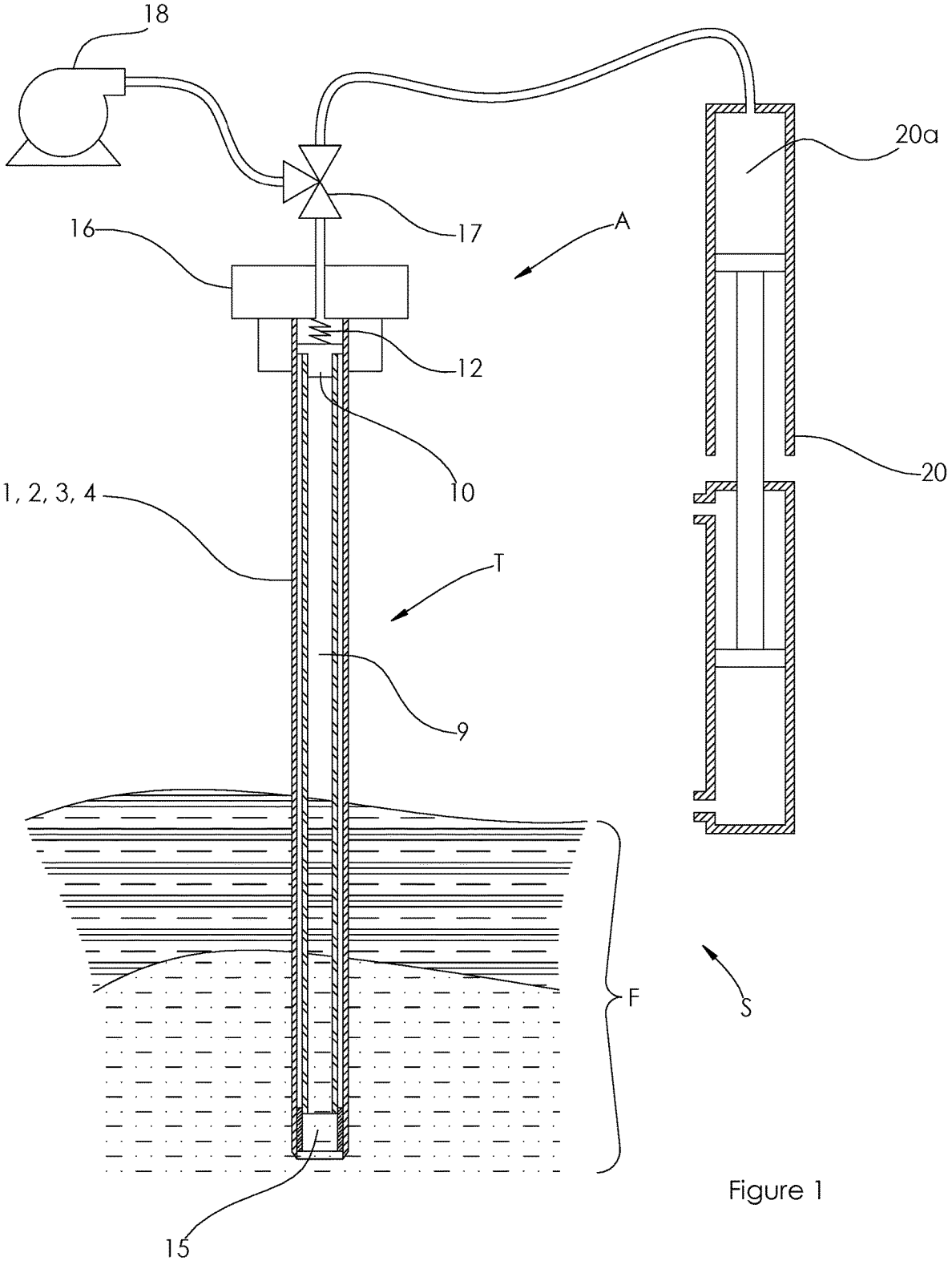
FIG. 1 is an overall schematic system view.

FIG. 1 represents the general system view of the described apparatus. The entire system [S] may be deployed from a vessel at the sea surface, and is completely submerged in water during operation to sample an undersea formation [F]. The system can be divided into two main components: (1) the coring tool [T]; and (2) the drilling apparatus [A].

Figure 2A:
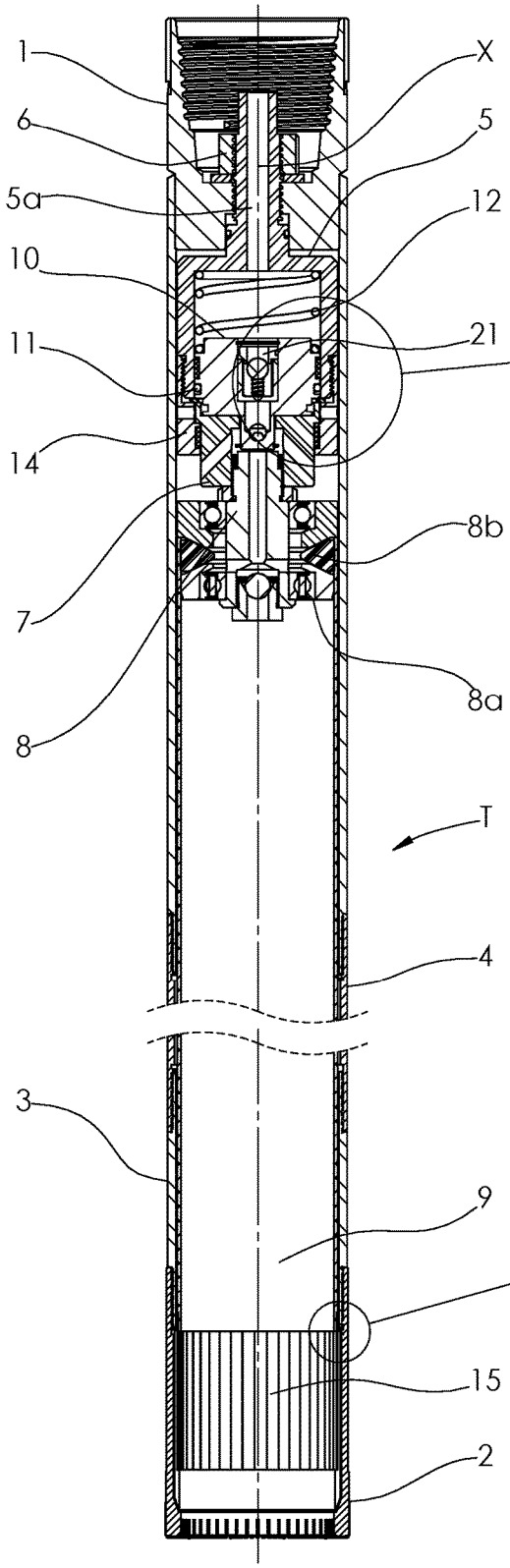
FIG. 2*a* is a cross-sectional side view depicting one representation of the coring apparatus in the assembled configuration.

With further reference to FIG. 2*a*, the coring tool T is largely cylindrical and is typically operated with the cylindrical axis [X] in a vertical orientation. The illustrated coring tool [T] is arranged similar to typical double-tube tools. Specifically, an inner tube or liner [9] is positioned within an outer tube [4]. The outer tube [4] is adapted for connecting to a drill string, and may include a female-threaded head [1] at the top that mates with the drill string. The outer tube [4] further includes a hollow cutting or coring bit [2] at the bottom to produce a core when drilling through the earth, and a reamer [3] to abet the cutting bit [2] with borehole definition. The thread profile of the head [1] is tapered to produce a mechanical seal between the drill string and coring tool [T].

The piston housing [5] is located within the head [1] to enable longitudinal adjustment of the internal tube or liner [9] with respect to the external or outer tube [4] and is fixed by a fastener, such as a lock nut [6].

To permit independent rotation of the outer tube [4], the liner [9] is connected to a sliding adapter [7] through a rotational bearing interface [8*a*] in the liner cap [8]. The internal liner [9] telescopes vertically via the sliding adapter [7] and piston [10] that allows the liner [9] to shift axially during actuation.

Figure 2B:
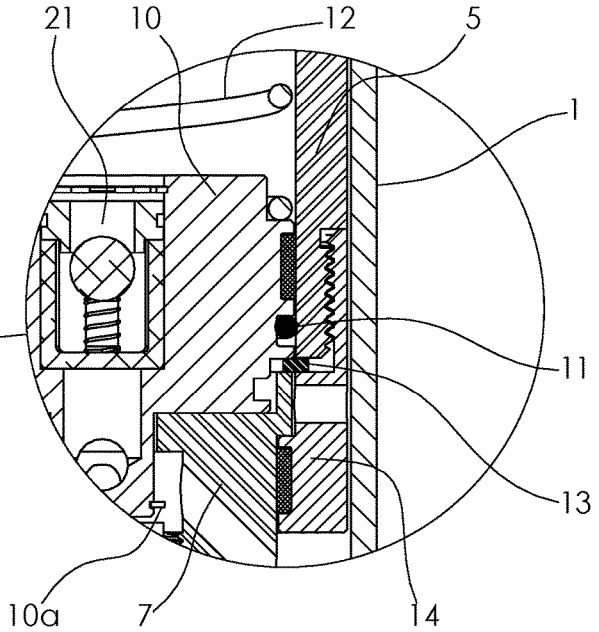
FIG. 2*b* is a detailed cross-sectional, partial view of the assembled telescoping mechanism from FIG. 2*a;*

In one embodiment, shown in FIGS. 2*a* and 2*b*, an actuator for moving the liner [9] comprises a piston [10] and piston seal [11] that can move axially within the piston housing [5]. A compression spring [12] seats the piston [10] and resists its displacement, and a retaining ring [13] that precludes movement of the sliding adapter [7]. An end cap [14] together with the piston housing [5] houses the piston [10].

During operation, the piston [10] is located in a preset position. In the preset position, the retaining ring [13] is expanded around the piston [10] and locked between the piston housing [5] and end cap [14] so that it is completely constrained from moving. Also, in this position, the sliding adapter [7] is fixed between the retaining ring [13] and the end cap [14], prohibiting it from shifting axially during operation of the coring tool [T], thereby locking the liner [9] in its original vertical position.

As illustrated in FIG. 2*a*, the liner [9] is affixed to the sliding adapter [7] through the liner cap [8]. In one embodiment, the liner cap [8] has a rubber seal [8*b*] that expands radially outwards when compressed to seal and grip the liner [9]. Alternative embodiments may rely on mechanical fastening of the liner cap [8] to the liner [9]. The liner [9] and sliding adapter [7] move axially as one component.

Figure 2C:
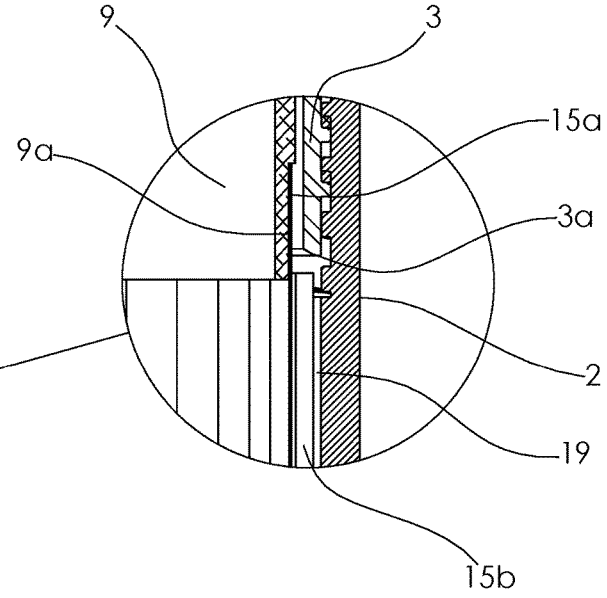
FIG. 2*c* is detailed cross-sectional, partial view of the assembled catcher retainer from FIG. 2*a*

At the lower end of the coring tool in the preset position, the catcher [15] is situated below the liner [9], as portrayed in FIG. 2*c*. The represented catcher [15] comprises an annular arrangement of axially extending, flexible fingers [15*a*] fixed to the inner face of a hollow tube [15*b*]. In their normal state, the fingers [15*a*] are arched and point towards the axis [X], obstructing the central cavity of the tool [T] and resemble an iris diaphragm when looking down the axis [X], as shown in FIG. 3*b*. Since the enclosing fingers [15*a*] block the central cavity in their default state (thereby sealing the core in the tool), they are pried outwards and slipped over the liner shoulder [9*a*] prior to operation, shown in FIG. 2*c*. This maintains an unimpeded aperture in the catcher [15] to allow the core to freely enter the tool [T] during the drilling operation.

The coring tool [T] is suspended, either directly or by extension of a hollow drill string, from the drive head [16] of the submerged drilling apparatus [A], which transmits the rotation and downward force required for coring. The system has an isolated volume circumscribed by the three-way valve [17], the drive head [16], the drill string, the piston housing fluid passage [5*a*], and the piston [10] and is completely sealed from the ambient fluid.

During coring, in a state represented by FIG. 2*a*, the tool [T] is rotated about axis [X] and simultaneously pushed into the earth, similar to traditional coring tools. The three-way valve [17] is open to the drill water pump [18] and fluid is pumped from the drilling apparatus [A] into the drill string at the drive head [16] and flows through the piston housing fluid passage [5*a*], the piston check valve [21], and down the narrow, annular gap [19] (see FIG. 2*c*) to the cutting bit [2]. After coring has been completed, the operator switches the three-way valve [17], closing off the drill water pump [18] and connecting the three-chamber hydraulic cylinder [20] to the drive head [16]. Then, the operator deliberately invokes hydraulic suction via the hydraulic cylinder [20] causing the internal liner [9] to telescope and release the fingers [15*a*] of the core catcher [15] from a constrained open state to a free normally closed state to capture the core.

By actuating the hydraulic cylinder [20], the isolated fluid is withdrawn from the drill string into the third chamber [20*a*] of the hydraulic cylinder [20]. The piston check valve [21] restricts ambient fluid from the bottom of the tool [T] from entering the drill string during suction. As the isolated volume expands, the pressure decreases, creating a pressure differential about the piston seal [11]. The pressure differential forces the piston [10] in the direction of the low-pressure region overcoming the downward force to maintain equilibrium.

Figure 3A:
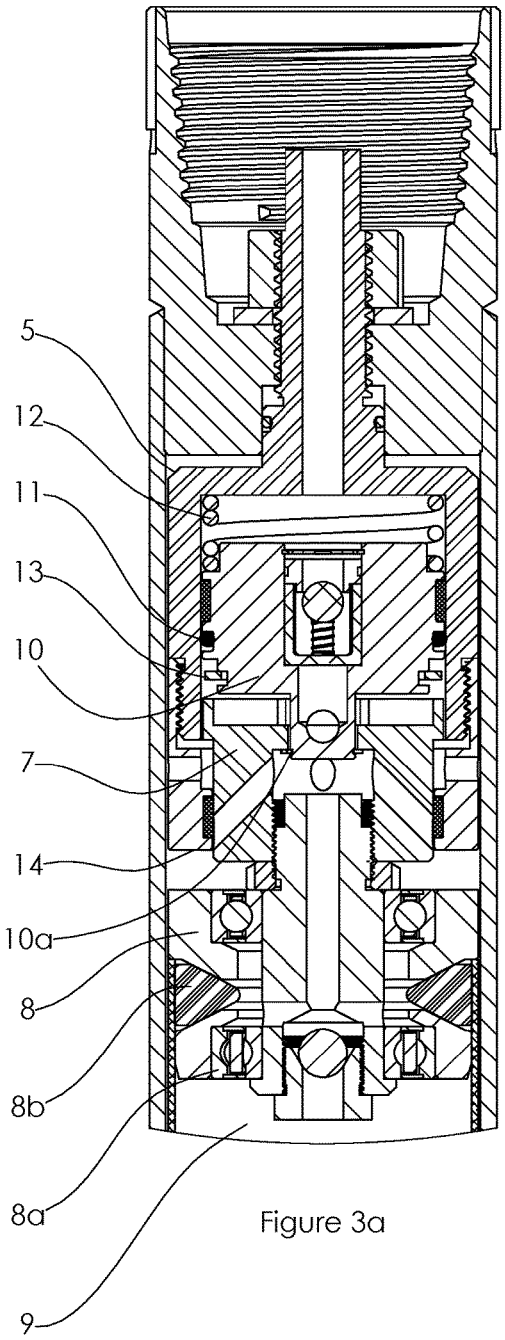
FIG. 3*a* is a cross-sectional side view depicting the telescoped assembly after suction is applied.

The change in position of the telescoping components can be visualized through FIG. 3*a*. As the piston [10] moves vertically during suction, the smaller diameter on the bottom of the piston [10] allows the retaining ring [13] to spring inwards to its default position, consequently unlocking the sliding adapter [7]. Once the piston [10] has reached a predefined position, the piston retaining ring [10*a*] pulls the sliding adapter [7], the liner cap [8], and liner [9] upwards.

Figure 3C:
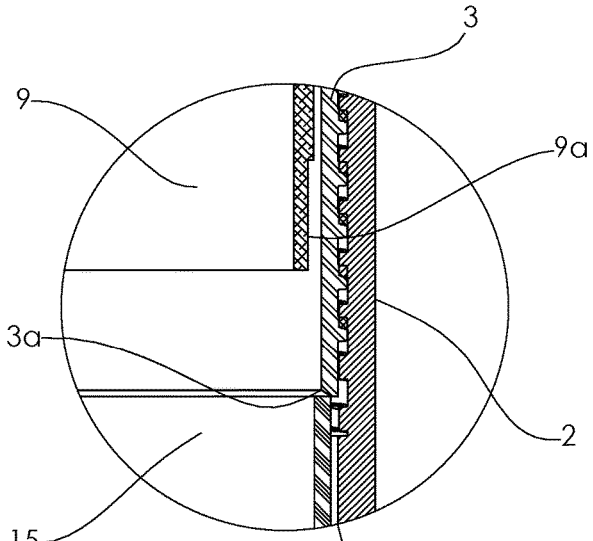
FIG. 3*c* is a detailed cross-sectional side view of FIG. 3*a* highlighting the structures that serve to release the catcher.
Figure 3B:
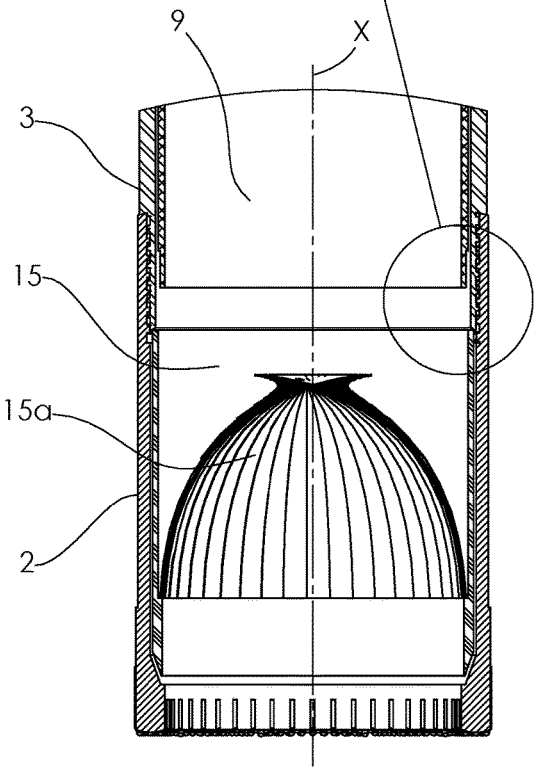
FIG. 3*b* is a detailed cross-sectional, partial view illustrating the release of the catcher after suction per FIG. 3*a*.

As the liner [9] moves upwards, the catcher [15] slides in tandem until making contact with the wall of the reamer [3*a*], shown in FIG. 3*c*, whereupon the enclosing fingers of the catcher [15] slip off the liner shoulder [9*a*] as the liner [9] continues to shift vertically up. After being released, the enclosing catcher fingers [15*a*] spring inwards to their default state to seal off the bottom of the coring apparatus and prevent the release of the sample.

This disclosure may be considered to relate to the following items:

1. An apparatus for recovering a core from an undersea formation, comprising:
   a coring tool for recovering the core from the undersea formation and a collapsible catcher having a closed state for capturing the core within the coring tool;
   an actuator for applying suction to the coring tool for causing the collapsible catcher to assume the closed state for capturing the core in the coring tool.
2. The apparatus of item 1, further including a retainer for retaining the collapsible catcher in the open state.
3. The apparatus of item 2, wherein the retainer comprises a liner movable axially within the coring tool.
4. The apparatus of item 3, wherein the actuator comprises a piston for moving the liner to a position for allowing the collapsible catcher to assume the closed state and capture the core in the coring tool.
5. The apparatus of item 4, wherein the actuator further comprises an external cylinder for applying suction to the coring tool for moving the piston.
6. The apparatus of item 5, wherein the external cylinder is connected to the coring tool by a three-way valve also connected to a pump for pumping fluid to the coring tool.
7. The apparatus of item 4, wherein the actuator further includes a housing for the piston, an axially movable piston seal, and a compression spring for seating the piston.
8. The apparatus of item 3, further including a sliding adapter connected to the liner and associated with a bearing for allowing relative rotation between the liner and an outer tube of the coring tool.

9. The apparatus of item 8, wherein the sliding adapter is fixed between a retaining ring and an end cap to prevent the liner from shifting axially during operation of the coring tool while the collapsible catcher is in the open state.

10. The apparatus of item 1, wherein the collapsible catcher comprises a plurality of flexible fingers extending in an axial direction of the coring tool in the open state.

11. The apparatus of item 10, wherein the plurality of flexible fingers are fixed at one end to a tube and biased toward the closed state of the collapsible catcher.

12. An undersea drilling system including the apparatus of any of items 1-11.

13. An apparatus for recovering a core from an undersea formation, comprising:

a coring tool for recovering the core from the undersea formation and a collapsible catcher comprising a plurality of flexible fingers adapted for moving between an open state and a closed state for capturing the core.

14. The apparatus of item 13, further including a retainer within the coring tool for retaining the plurality of flexible fingers in the open state, and a piston for moving the retainer within the coring tool to a position for releasing the plurality flexible fingers of the collapsible catcher so as to capture the core in the coring tool.

15. The apparatus of item 14, wherein the retainer comprises a telescoping liner adapted for moving axially within an outer tube of the coring tool.

16. The apparatus of item 14, further including an actuator for moving the piston.

17. The apparatus of item 14, wherein the actuator comprises an external cylinder for applying suction to the coring tool.

18. An undersea drilling system including the apparatus of any of items 13-17.

19. An apparatus for recovering a core from an undersea formation, comprising:

a coring tool for recovering the core from the undersea formation and a collapsible catcher for capturing the core; and an external cylinder for applying suction to the coring tool to cause the collapsible catcher to collapse for capturing the core within the coring tool.

20. The apparatus of item 19, further including a retainer within the coring tool for retaining the collapsible catcher in an open state, and a piston for moving the retainer within the coring tool responsive to suction applied by the external cylinder to a position for causing the collapsible catcher to collapse.

21. The apparatus of item 19, wherein the collapsible catcher comprises a plurality of flexible fingers extending in an axial direction of the coring tool in the open state.

22. The apparatus of item 21, wherein the plurality of flexible fingers are fixed at one end to a tube and biased toward the closed state of the collapsible catcher.

23. An undersea drilling system including the apparatus of any of items 19-22.

24. A method for recovering a core from an undersea formation, comprising:

recovering the core within a coring tool; and applying suction to the coring tool to cause a catcher to collapse and seal the core within the coring tool.

25. The method of item 24, wherein the step of applying suction comprises moving a piston within the coring tool to move an associated retainer holding the catcher in an open position to allow the catcher to collapse.

26. A method for recovering a core from an undersea formation, comprising:

recovering the core within a coring tool; and collapsing a plurality of flexible fingers inwardly to a closed state to seal the core within the coring tool.

27. The method of item 26, wherein the collapsing step comprises applying suction to the coring tool to move a liner normally holding the plurality of flexible fingers in an open state.

Each of the following terms written in singular grammatical form: "a", "an", and the", as used herein, means "at least one", or "one or more". Use of the phrase One or more" herein does not alter this intended meaning of "a", "an", or "the". Accordingly, the terms "a", "an", and "the", as used herein, may also refer to, and encompass, a plurality of the stated entity or object, unless otherwise specifically defined or stated herein, or, unless the context clearly dictates otherwise. For example, the phrases: "a unit", "a device", "an assembly", "a mechanism", "a component, "an element", and "a step or procedure", as used herein, may also refer to, and encompass, a plurality of units, a plurality of devices, a plurality of assemblies, a plurality of mechanisms, a plurality of components, a plurality of elements, and, a plurality of steps or procedures, respectively.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated components), feature(s), characteristic(s), parameter(s), integer(s), or step(s), and does not preclude addition of one or more additional components), feature(s), characteristic(s), parameter(s), integer(s), step(s), or groups thereof. Each of these terms is considered equivalent in meaning to the phrase "consisting essentially of. Each of the phrases "consisting of and "consists of," as used herein, means "including and limited to".

The phrase "consisting essentially of," as used herein, means that the stated entity or item (system, system unit, system sub-unit device, assembly, sub-assembly, mechanism, structure, component element or, peripheral equipment utility, accessory, or material, method or process, step or procedure, sub-step or sub-procedure), which is an entirety or part of an exemplary embodiment of the disclosed invention, or/and which is used for implementing an exemplary embodiment of the disclosed invention, may include at least one additional feature or characteristic" being a system unit system sub-unit device, assembly, sub-assembly, mechanism, structure, component or element or, peripheral equipment utility, accessory, or material, step or procedure, sub-step or sub-procedure), but only if each such additional feature or characteristic" does not materially alter the basic novel and inventive characteristics or special technical features, of the claimed item.

The term "method", as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Terms of approximation, such as the terms about, substantially, approximately, etc., as used herein, refers to ±10% of the stated numerical value.

The phrase "operatively connected," as used herein, equivalently refers to the corresponding synonymous phrases "operatively joined", and "operatively attached," where the operative connection, operative joint or operative attachment, is according to a physical, or/and electrical, or/and electronic, or/and mechanical, or/and electro-mechanical, manner or nature, involving various types and kinds of hardware or/and software equipment and components.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub-combination in the context or format of a single embodiment may also be illustratively described and presented in the context or format of a plurality of separate embodiments.

The invention claimed is:

1. An apparatus for recovering a core from an undersea formation, comprising:

a coring tool for recovering the core from the undersea formation and a collapsible catcher having a closed state for capturing the core within the coring tool; and an actuator for applying suction to the coring tool for directly causing the collapsible catcher to assume the closed state for capturing the core in the coring tool.

2. The apparatus of claim 1, further including a retainer for retaining the collapsible catcher in the open state.

3. The apparatus of claim 2, wherein the retainer comprises a liner movable axially within the coring tool as a result of the applied suction.

4. The apparatus of claim 3, wherein the actuator comprises a piston for moving the liner to a position for allowing the collapsible catcher to assume the closed state and capture the core in the coring tool, and an external cylinder for applying suction to the coring tool for moving the piston.

5. The apparatus of claim 4, wherein the external cylinder is connected to the coring tool by a three-way valve also connected to a pump for pumping fluid to the coring tool.

6. The apparatus of claim 4, wherein the actuator further includes a housing for the piston, an axially movable piston seal, and a compression spring for seating the piston.

7. The apparatus of claim 3, further including a sliding adapter connected to the liner and associated with a bearing for allowing relative rotation between the liner and an outer tube of the coring tool.

8. The apparatus of claim 7, wherein the sliding adapter is fixed between a retaining ring and an end cap to prevent the liner from shifting axially during operation of the coring tool while the collapsible catcher is in the open state.

9. The apparatus of claim 1, wherein the collapsible catcher comprises a plurality of flexible fingers extending in an axial direction of the coring tool in the open state.

10. The apparatus of claim 9, wherein the plurality of flexible fingers are fixed at one end to a tube and biased toward the closed state of the collapsible catcher.

11. An undersea drilling system including the apparatus claim 1.

12. An apparatus for recovering a core from an undersea formation, comprising:

a coring tool for recovering the core from the undersea formation and a collapsible catcher comprising a plurality of flexible fingers adapted for moving between an open state and a closed state for capturing the core; and an actuator comprising an external cylinder for applying suction to the coring tool for directly causing the collapsible catcher to assume the closed state for capturing the core in the coring tool.

13. The apparatus of claim 12, further including a retainer within the coring tool for retaining the plurality of flexible fingers in the open state, and a piston for moving the retainer within the coring tool to a position for releasing the plurality flexible fingers of the collapsible catcher so as to capture the core in the coring tool.

14. The apparatus of claim 13, wherein the retainer comprises a telescoping liner adapted for moving axially within an outer tube of the coring tool.

15. An undersea drilling system including the apparatus of claim 12.

16. An apparatus for recovering a core from an undersea formation, comprising:

a coring tool for recovering the core from the undersea formation and a collapsible catcher for capturing the core; and an external cylinder for applying suction to the coring tool to directly cause the collapsible catcher to collapse for capturing the core within the coring tool.

17. The apparatus of claim 16, further including a retainer within the coring tool for retaining the collapsible catcher in an open state, and a piston for moving the retainer within the coring tool responsive to suction applied by the external cylinder to a position for causing the collapsible catcher to collapse.

18. The apparatus of claim 16, wherein the collapsible catcher comprises a plurality of flexible fingers extending in an axial direction of the coring tool in the open state.

19. The apparatus of claim 18, wherein the plurality of flexible fingers are fixed at one end to a tube and biased toward the closed state of the collapsible catcher.

20. An undersea drilling system including the apparatus of claim 16.

21. A method for recovering a core from an undersea formation, comprising:

recovering the core within a coring tool; and applying suction to the coring tool to directly cause a catcher to collapse and retain the core within the coring tool.

22. The method of claim 21, wherein the step of applying suction comprises moving a piston within the coring tool to move an associated retainer holding the catcher in an open position to allow the catcher to collapse.

23. A method for recovering a core from an undersea formation, comprising:

recovering the core within a coring tool; and collapsing a plurality of flexible fingers inwardly to a closed state to seal the core within the coring tool;

wherein the collapsing step comprises applying suction to the coring tool to move a liner normally holding the plurality of flexible fingers in an open state.

* * * * *